US009515382B2

(12) United States Patent
Tsubaki et al.

(10) Patent No.: US 9,515,382 B2
(45) Date of Patent: Dec. 6, 2016

(54) ANTENNA DEVICE AND WIRELESS COMMUNICATION APPARATUS

(71) Applicant: Murata Manufacturing Co., Ltd., Nagaokakyo-shi, Kyoto-fu (JP)

(72) Inventors: Nobuhito Tsubaki, Nagaokakyo (JP); Noboru Kato, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 239 days.

(21) Appl. No.: 14/217,901

(22) Filed: Mar. 18, 2014

(65) Prior Publication Data

US 2014/0198011 A1 Jul. 17, 2014

Related U.S. Application Data

(63) Continuation of application No. PCT/JP2013/063016, filed on May 9, 2013.

(30) Foreign Application Priority Data

May 28, 2012 (JP) ..... 2012-120770
Mar. 12, 2013 (JP) ..... 2013-048560

(51) Int. Cl.
*H01Q 7/00* (2006.01)
*H01Q 7/06* (2006.01)
*H01Q 21/08* (2006.01)

(52) U.S. Cl.
CPC ..... *H01Q 7/00* (2013.01); *H01Q 7/06* (2013.01); *H01Q 21/08* (2013.01)

(58) Field of Classification Search
CPC ..... H01Q 7/00
USPC ..... 343/867
See application file for complete search history.

(56) References Cited

U.S. PATENT DOCUMENTS

2007/0051807 A1 3/2007 Yamaguchi
2013/0181876 A1* 7/2013 Miura ..... G06K 7/10316 343/788

FOREIGN PATENT DOCUMENTS

EP 2 573 871 A1 3/2013
JP 2008-306689 A 12/2008
JP 2009-021970 A 1/2009
JP 4325621 B2 9/2009
JP WO2012/033031 * 3/2012 ..... H01Q 7/00
JP 2013-141164 A 7/2013
WO 2012/033031 A1 3/2012

OTHER PUBLICATIONS

Official Communication issued in International Patent Application No. PCT/JP2013/063016, mailed on Aug. 6, 2013.

* cited by examiner

*Primary Examiner* — Dameon E Levi
*Assistant Examiner* — Andrea Lindgren Baltzell
(74) *Attorney, Agent, or Firm* — Keating & Bennett, LLP

(57) ABSTRACT

An antenna device includes a feeding coil antenna and a booster coil antenna electromagnetically coupled to the feeding coil antenna. The feeding coil antenna includes a plurality of coil portions including at least one magnetic body and each including a coil conductor wound around the at least one magnetic body. The plurality of coil portions are connected to one another in an in-phase mode, and are arranged near one another such that winding axes of the coil conductors are oriented approximately in the same direction and at least portions of respective openings of the coil conductors face one another.

19 Claims, 10 Drawing Sheets

ANTENNA DEVICE AND WIRELESS COMMUNICATION APPARATUS

BACKGROUND OF THE INVENTION

1. Field of the Invention

The present invention relates to antenna devices, such as antenna devices preferably for use in a non-contact communication system, for example, a near-field communication (NFC) system, and relates to wireless communication apparatuses including the antenna devices.

2. Description of the Related Art

In recent years, cellular phones and the like each include therein an antenna device used in a non-contact communication system in the 13.56 MHz band, for example. Such an antenna device requires a large coil antenna to obtain a favorable communication range, and the coil antenna is attached to the inner surface of a terminal casing where a relatively large space is available. A feeding circuit (RFIC chip) for processing RF signals is DC-connected to the coil antenna through a connector or pins.

However, in the case of DC connection described above, there is a problem in that contact resistance varies with the roughness of the contact surface, oxidization, and contact pressure, and there is also a reliability problem in that contact failure occurs due to a mechanical shock caused by vibration or dropping.

Hence, it is proposed in Japanese Unexamined Patent Application Publication No. 2008-306689 and Japanese Patent No. 4325621 that a transmission/reception antenna connected to an RFIC chip mounted on a substrate through wiring provided on the substrate and a resonant antenna provided, for example, on the inner surface of a terminal casing are operated in such a manner as to be electromagnetically coupled to each other. According to this proposition, the problems described above are solved and, in addition, the size of the transmission/reception antenna can be reduced since the transmission/reception antenna need only be coupled to the resonant antenna.

However, if the distance between a booster coil antenna and a feeding coil antenna fluctuates, the magnitude of the electromagnetic coupling between the two varies, resulting in a problem in that communication characteristics are degraded since a resonant frequency deviates from a desired value. Further, not all the magnetic fluxes generated by the feeding coil form closed loops. Hence, an increase in the degree of coupling between the two antennas is limited and it is difficult to adjust the degree of coupling to obtain a desired operation frequency.

SUMMARY OF THE INVENTION

Preferred embodiments of the present invention provide an antenna device and a wireless communication apparatus that allow the degree of coupling between a feeding coil antenna and a booster coil antenna to be easily adjusted and, in particular, allow the degree of coupling to be increased.

An antenna device according to a first preferred embodiment of the present invention includes a feeding coil antenna, and a booster coil antenna arranged in such a manner as to be electromagnetically coupled to the feeding coil antenna, wherein the feeding coil antenna includes a plurality of coil portions including at least one magnetic body and each including a coil conductor wound around the at least one magnetic body, the plurality of coil portions are connected to one another in an in-phase mode, and are arranged near one another such that winding axes of the coil conductors are oriented approximately in the same direction and at least portions of respective openings of the coil conductors face one another.

A wireless communication apparatus according to a second preferred embodiment of the present invention includes a feeding circuit, a feeding coil antenna connected to the feeding circuit, and a booster coil antenna electromagnetically coupled to the feeding coil antenna, wherein the feeding coil antenna includes a plurality of coil portions including at least one magnetic body and each including a coil conductor wound around the at least one magnetic body, and the plurality of coil portions are connected to one another in an in-phase mode, and are located near one another such that winding axes of the coil conductors are oriented approximately in the same direction and at least portions of respective openings of the coil conductors face one another.

In the antenna device, a feeding coil antenna preferably includes a plurality of coil portions, and the resonant frequency of the feeding coil antenna is configured to adjusted in accordance with the positional relationship among the plurality of coil portions. In particular, magnetic flux enters portions between the plurality of coil portions, and magnetic flux radiated from the feeding coil antenna to an inner side portion defines a closed loop. As a result, the degree of coupling between the feeding coil antenna and the booster coil antenna is increased such that communication characteristics are enhanced.

According to various preferred embodiments of the present invention, the degree of coupling between a feeding coil antenna and a booster coil antenna is easily adjusted and, in particular, the degree of coupling is increased such that communication characteristics are enhanced.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 8A and 8B illustrate a third example of the feeding coil antenna, wherein FIG. 8A is an explanation diagram illustrating an arrangement pattern, and FIG. 8B is an explanation diagram illustrating electromagnetic coupling between the feeding coil antenna and the booster coil antenna.

FIG. 9A is an explanation diagram illustrating an arrangement pattern, and FIG. 9B is an explanation diagram illustrating electromagnetic coupling between the feeding coil antenna and the booster coil antenna.

DETAILED DESCRIPTION OF THE PREFERRED EMBODIMENTS

Hereinafter, preferred embodiments of an antenna device and a wireless communication apparatus according to the present invention will be described with reference to the accompanying drawings. Note that components and portions common in the figures are denoted by the same reference symbols and duplicate description thereof is omitted.

Figure 1:
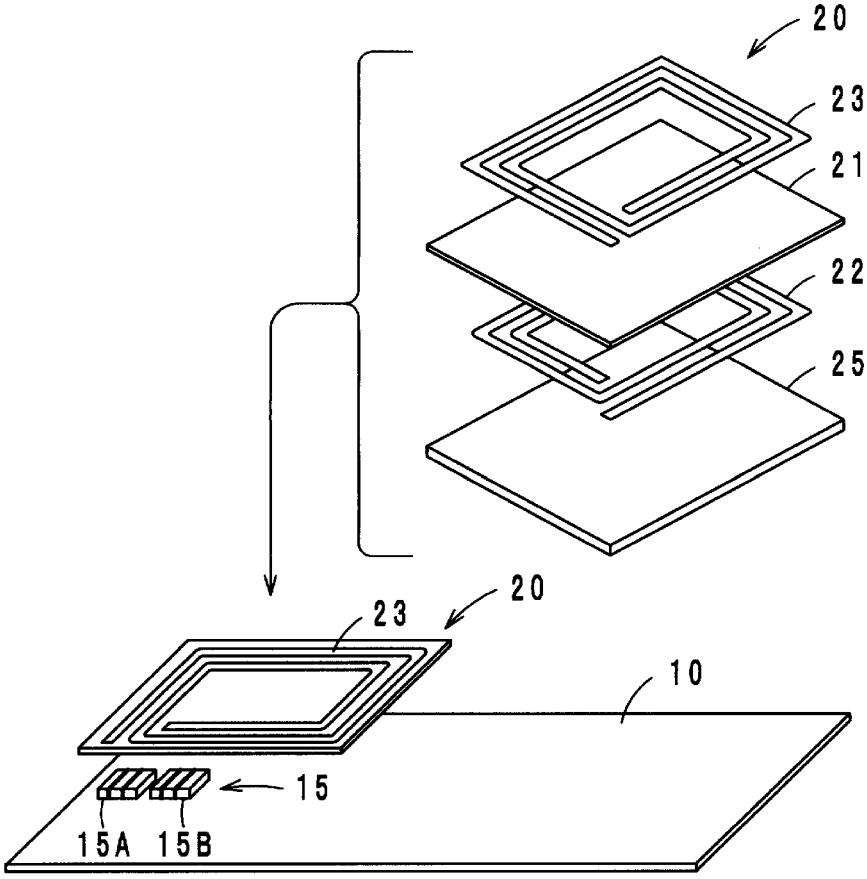
FIG. 1 is an exploded perspective view of major portions of an antenna device according to a preferred embodiment of the present invention.

Referring to FIG. 1, an antenna device according to a preferred embodiment has a configuration in which a feeding coil antenna 15 (including coil portions 15A and 15B) is arranged on a circuit substrate (printed wire substrate 10), a booster coil antenna 20 including coil conductors 22 and 23 respectively provided on the lower surface and upper surface of an insulating layer 21 is provided, and the feeding coil antenna 15 is arranged near a portion of one of the sides of the booster coil antenna 20. A magnetic layer 25 is provided between the booster coil antenna 20 and the printed wire substrate 10. The booster coil antenna 20 defines and functions as a radiation element that is capable of transmitting/receiving an HF-band high-frequency signal.

Figure 2A:
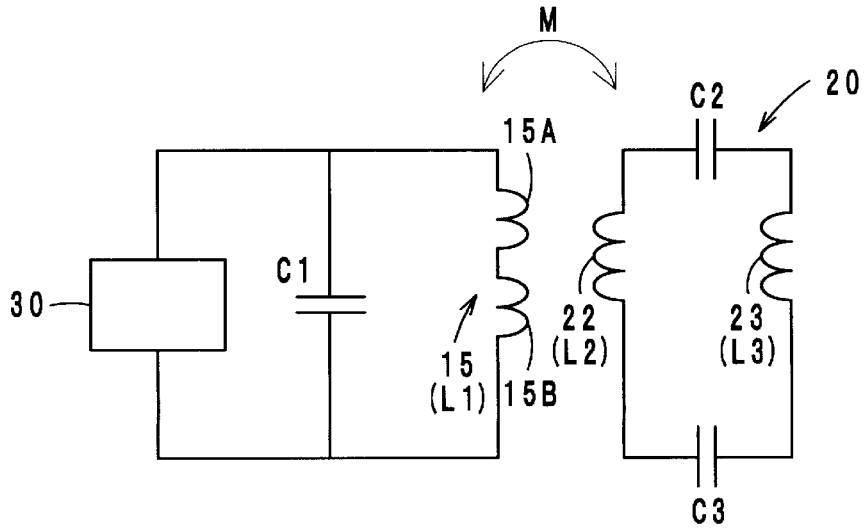
FIGS. 2A and 2B are equivalent circuits of the antenna device.

This antenna device has an equivalent circuit illustrated in FIG. 2A. The feeding coil antenna 15 (coil portions 15A and 15B) is connected to a feeding circuit (RFIC chip 30), and includes an inductor component L1 (composite inductor component of the coil portions 15A and 15B) and a capacitor component C1 defining a parallel resonant circuit. The resonant frequency is mainly adjusted by changing the capacitance of the capacitor component C1. The booster coil antenna 20 defines a series resonant circuit including inductor components L2 and L3 respectively corresponding to the coil conductors 22 and 23 and interline capacitor components C2 and C3. The feeding coil antenna 15 (inductor component L1) is electromagnetically coupled (denoted by the symbol M) to the booster coil antenna 20 (inductor components L2 and L3).

A feeding circuit includes the RFIC chip 30, a memory circuit and a logic circuit. The feeding circuit may be provided as a bare IC chip or a package IC.

Figure 2B:
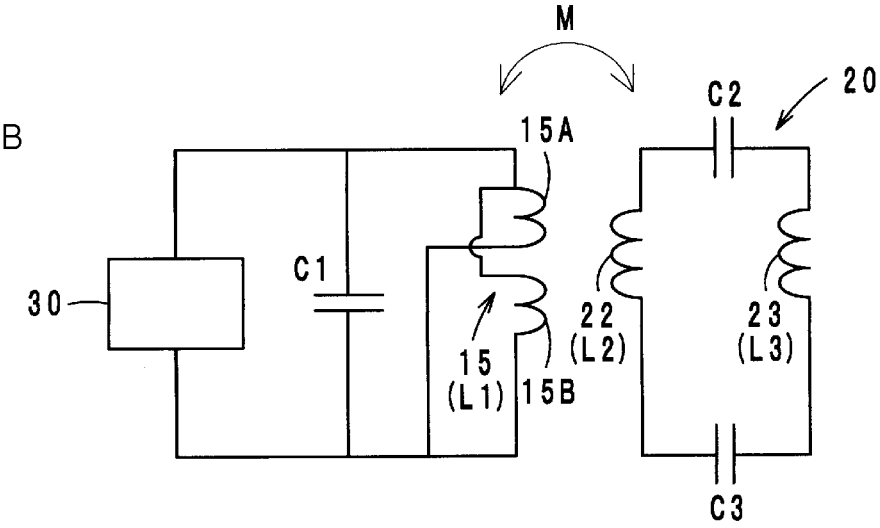
Figure 3:
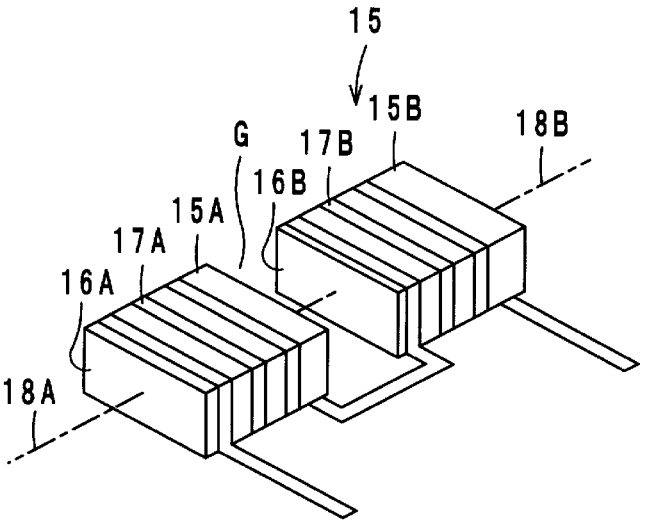
FIG. 3 is a perspective view of a first example of a feeding coil antenna.

Referring to FIG. 3, the feeding coil antenna 15 includes the first coil portion 15A and the second coil portion 15B including magnetic cores 16A and 16B and coil conductors 17A and 17B respectively wound around the magnetic cores 16A and 16B. The feeding coil antenna 15 is mounted on the printed wire substrate 10, and the coil conductors 17A and 17B are connected in series or in parallel with each other via a conductor provided on the printed wire substrate 10 (refer to FIGS. 2A and 2B). The first and second coil portions 15A and 15B are connected to each other in an in-phase mode and are arranged in such a manner that winding axes 18A and 18B of the coil conductors 17A and 17B are oriented in about the same direction, and the openings of the coil conductors 17A and 17B face each other with a gap G therebetween in such a manner as to be close to each other.

The magnetic cores 16A and 16B are preferably made of ferrite. The coil conductors 17A and 17B may be made of a conductive material using, for example, thin-film photolithography, or may be made of thick layers using conductive paste. Further, the coil conductors 17A and 17B may be configured by winding conductors, or may be configured such that by stacking a plurality of magnetic sheets having coil conductors located thereon, the coil conductors provided on the magnetic sheets are connected to one another through via hole conductors thus configuring a spiral shape. The coil conductors 22 and 23 of the booster coil antenna 20 are made of a conductive material on the insulating layer 21, using, for example, photolithography, although not limited to this.

Figure 4:
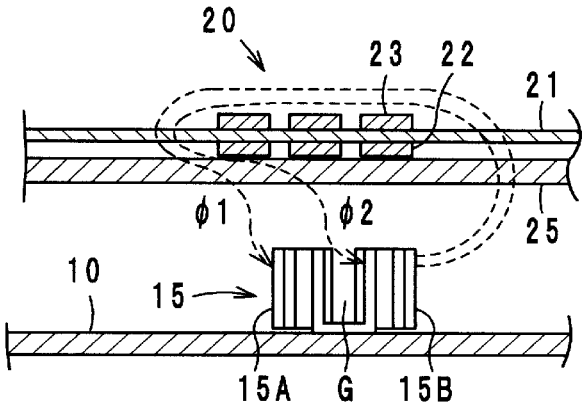
FIG. 4 is an explanation diagram illustrating electromagnetic coupling between the feeding coil antenna and a booster coil antenna in the antenna device.

In the antenna device, the feeding coil antenna 15 is provided of the first and second coil portions 15A and 15B, and as illustrated in FIG. 4, a magnetic flux $\phi$1 radiated from the feeding coil antenna 15 defines a closed loop going around the coil conductors 22 and 23, such that the feeding coil antenna 15 and the booster coil antenna 20 are electromagnetically coupled to each other. Further, a magnetic flux $\phi$2 passing parallel to and on the inner side of the magnetic flux $\phi$1 penetrates into the gap G between the first and second coil portions 15A and 15B thus defining a closed loop. In the case where the feeding coil antenna 15 is a single component, the magnetic flux $\phi$2 becomes a leakage magnetic flux, but in the present wireless communication apparatus, the magnetic flux $\phi$2 also defines a closed loop. As a result, the degree of coupling between the feeding coil antenna 15 and the booster coil antenna 20 is increased and, hence, the communication characteristics are enhanced.

By dividing the feeding coil antenna 15 into a plurality of components, DC current superposition characteristics are enhanced and variations in inductance due to variations in the magnitude of a current flowing through the feeding coil antenna 15 are reduced. The feeding coil antenna 15 needs to have a larger size to obtain better communication characteristics. However, since the magnetic cores are formed of comparatively fragile sintered bodies, there is a limit to how much the size can be increased. In the present preferred embodiment, by dividing the feeding coil antenna 15 into the first and second coil portions 15A and 15B, the sizes of the magnetic cores 16A and 16B are made small so as to prevent generation of defects, such as cracks, and realize favorable communication characteristics.

The feeding coil antenna 15 is arranged near the booster coil antenna 20 in such a manner that the coil portions 15A and 15B are at least partly superposed with a portion of one of the sides of the booster coil antenna 20 (i.e., one side of the coil conductor 22 or 23) when viewed in plan in the winding axis direction of the coil conductors 22 and 23 of the booster coil antenna 20. As a result, a favorable degree of coupling between the antennas 15 and 20 is achieved.

Further, the resonant frequency of the feeding coil antenna 15 is adjustable in accordance with the positional relationship between the first and second coil portions 15A and 15B. In other words, the total inductance is changeable in accordance with the positional relationship between the first and second coil portions 15A and 15B. Hereinafter, referring to FIGS. 5A to 5F, various patterns of arranging the feeding coil antenna 15 will be illustrated.

Figure 5A:
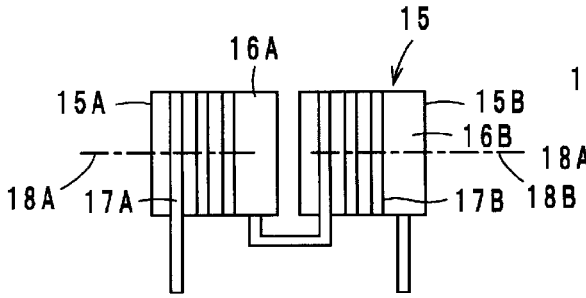
FIGS. 5A to 5F are explanation diagrams illustrating various arrangement patterns of the feeding coil antenna.
Figure 5B:
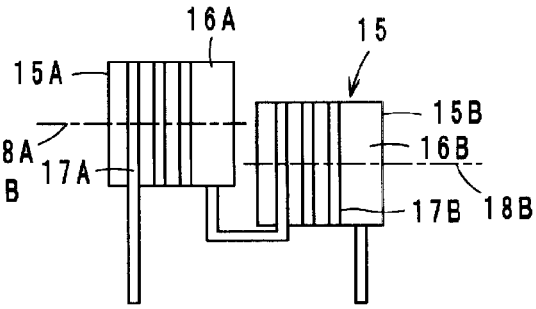
Figure 5C:
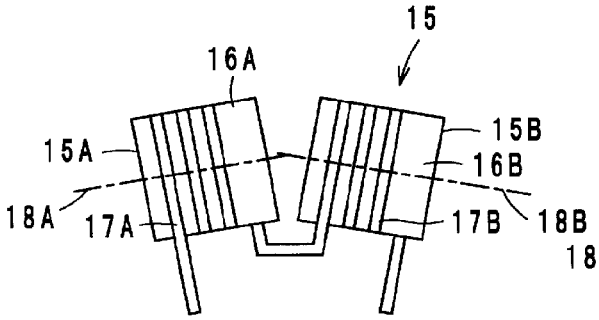

FIG. 5A is the first arrangement pattern illustrated in FIG. 3. Here, the magnetic cores 16A and 16B preferably have the same size, and the coil conductors 17A and 17B preferably have the same number of turns. The winding axes 18A and 18B coincide with each other. In a second arrangement pattern illustrated in FIG. 5B, the magnetic cores 16A and 16B preferably have the same size and the coil conductors 17A and 17B preferably have the same number of turns. The winding axes 18A and 18B are oriented in the same direction but are offset from each other. In a third arrangement pattern illustrated in FIG. 5C, the magnetic cores 16A and 16B preferably have the same size and the coil conductors 17A and 17B preferably have the same number of turns. The winding axis 18B is oriented in a direction inclined with respect to the winding axis 18A.

Figure 5D:
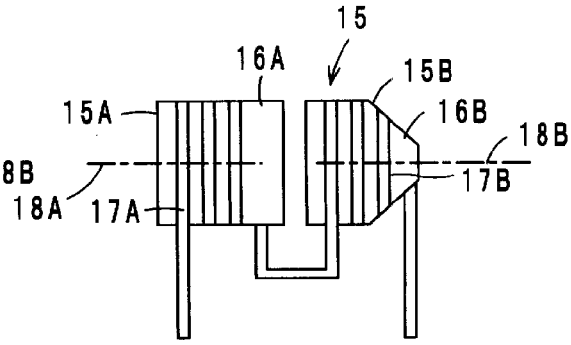

In a fourth arrangement pattern illustrated in FIG. 5D, the magnetic cores 16A and 16B preferably have the same external diameter and the coil conductors 17A and 17B preferably have the same number of turns. However, the end portion of the magnetic core 16B preferably has a tapered shape. The winding axes 18A and 18B coincide with each other. In the fourth arrangement pattern, since the end portion of the magnetic core 16B is tapered, interference with the round corner of the casing of a wireless communication apparatus is avoided.

Figure 5E:
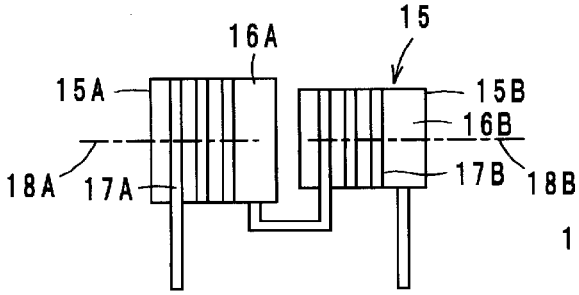
Figure 5F:
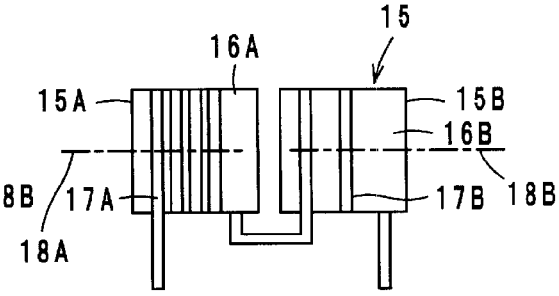

In a fifth arrangement pattern illustrated in FIG. 5E, the magnetic core 16B has a smaller external diameter than the magnetic core 16A. The coil conductors 17A and 17B have the same number of turns and the winding axes 18A and 18B coincide with each other. In a sixth arrangement pattern illustrated in FIG. 5F, the magnetic cores 16A and 16B have the same size, but the coil conductor 17B has a smaller number of turns than the coil conductor 17A, and the winding axes 18A and 18B coincide with each other.

Figure 6A:
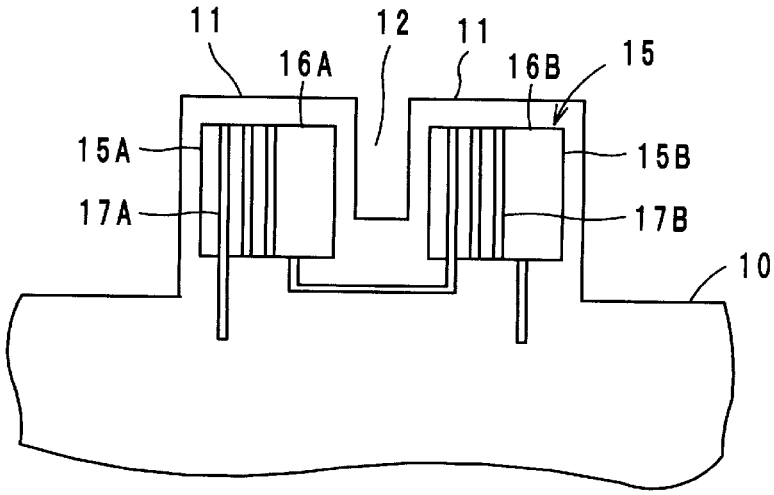
FIG. 6A is a plan view illustrating an advantage of the first example of the feeding coil antenna.
Figure 6B:
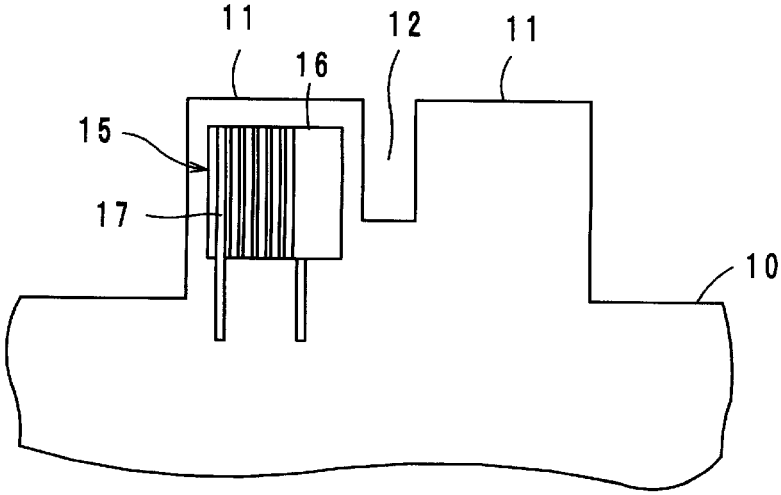
FIG. 6B is a plan view of a comparative example of the feeding coil antenna.

In recent years, it is difficult to secure a space for mounting an antenna device due to a reduction in device size and increased component mounting density. However, by dividing the antenna device into the first and second coil portions 15A and 15B as in the present preferred embodiment, a mounting space is efficiently utilized. For example, as illustrated in FIG. 6A, when protruding portions 11 and a depressed portion 12 are provided at the edge portion of the printed wire substrate 10, the first and second coil portions 15A and 15B are provided in the protruding portions 11, avoiding the depressed portion 12, in the present preferred embodiment. If a feeding coil antenna 15 including a single coil portion is to be used, the feeding coil antenna 15 will be provided in one of the protruding portions 11, as illustrated in FIG. 6B. Hence, it is required that a core conductor 17 having a reduced width be wound around a magnetic core 16 with a fine pitch. However, with this configuration, the inductance of the feeding coil antenna 15 is reduced or the radiation characteristics are degraded, resulting in degradation of the communication characteristics.

Figure 7:
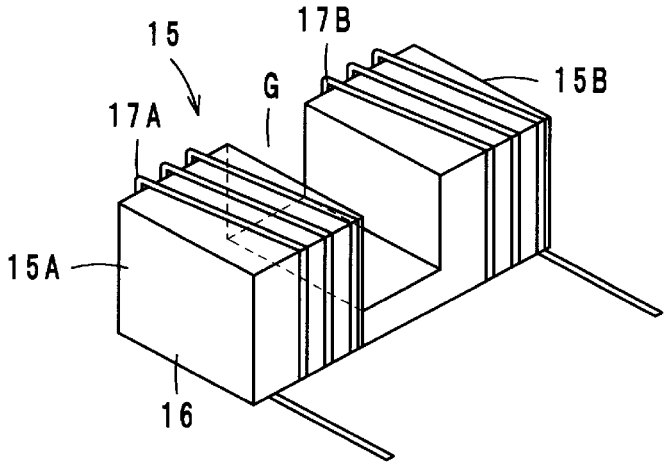
FIG. 7 is a perspective view of a second example of the feeding coil antenna.

Next, a second example of the feeding coil antenna 15 will be described with reference to FIG. 7. This feeding coil antenna 15 has a configuration in which a magnetic core 16 is a single body, two portions of the magnetic core 16 where coil conductors 17A and 17B are respectively wound have the same external diameter, and a cut-out portion (gap G) is provided between the two portions. Note that the cut-out portion (gap G) may be filled with a dielectric material. As illustrated in FIG. 4, an inner magnetic flux $\phi 2$ defines a closed loop due to the gap G similarly to the first example described above.

Figure 8A:
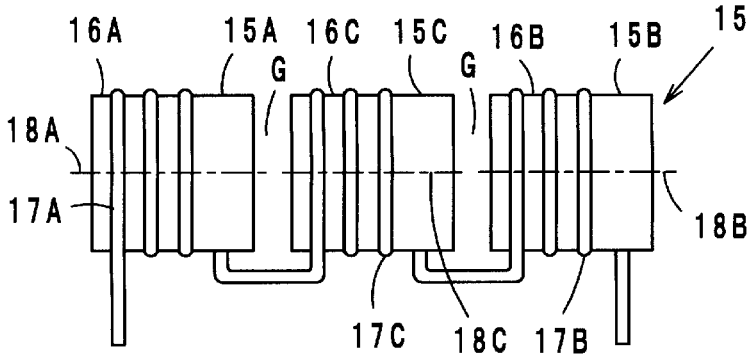
Figure 8B:
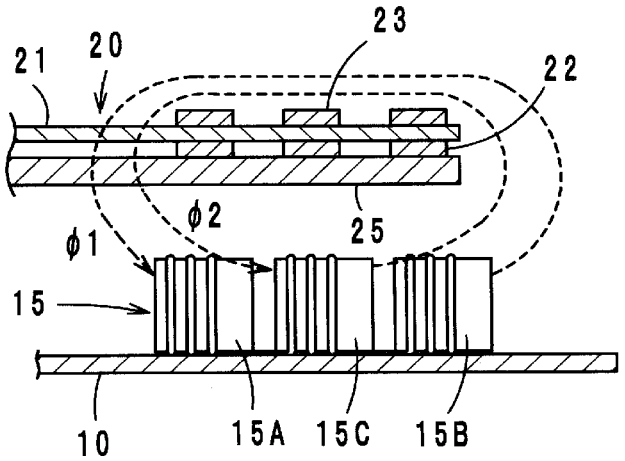

A third example of the feeding coil antenna 15 will be described with reference to FIGS. 8A and 8B. This feeding coil antenna 15 has a configuration in which a third coil portion 15C is provided between first and second coil portions 15A and 15B, as illustrated in FIG. 8A. Also in this third example, coil conductors 17A, 17B, and 17C are connected in series or in parallel with one another in an in-phase mode, and winding axes 18A, 18B, and 18C are oriented in substantially the same direction. Openings of the coil conductors 17A, 17B, and 17C face one another with gaps G therebetween so as to be close to one another.

This feeding coil antenna 15 has a configuration in which an end portion of the first coil portion 15A is arranged near the inner side portions of the coil conductors 22 and 23 and an end portion of the second coil portion 15B is arranged near the outer side portions of the coil conductors 22 and 23, in plan view. As a result, as illustrated in FIG. 8B, a magnetic flux $\phi 1$ radiated from the end portion of the second coil portion 15B flows to the end portion of the first coil portion 15A passing through a portion directly above the coil conductors 22 and 23, thus defining a closed loop. Further, a leakage magnetic flux $\phi 2$ radiated from an end portion of the third coil portion 15C flows through a portion directly above the coil conductors and 23 and returns to the third coil portion 15C, thus defining a closed loop. As a result, the degree of coupling between the feeding coil antenna 15 and the booster coil antenna 20 is increased and the communication characteristics are enhanced.

Figure 9A:
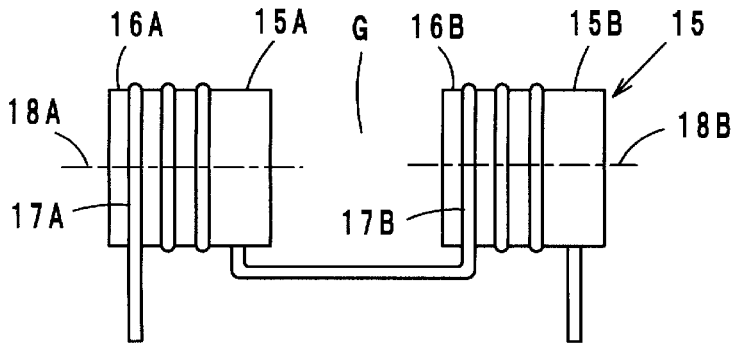
FIGS. 9A and 9B illustrate a fourth example of the feeding coil antenna.
Figure 9B:
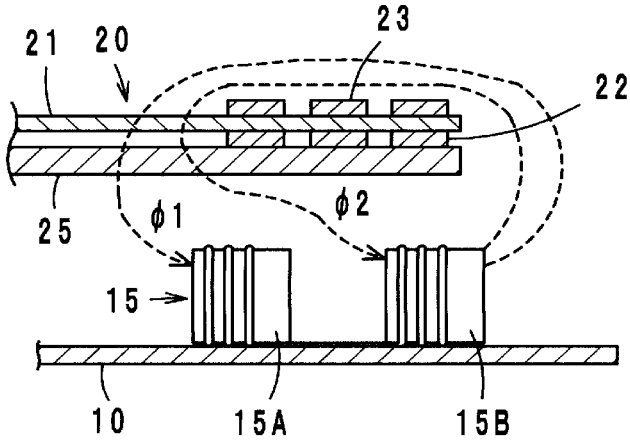

A fourth example of the feeding coil antenna 15 will be described with reference to FIGS. 9A and 9B. Referring to FIG. 9A, this feeding coil antenna 15 includes first and second coil portions 15A and 15B similarly to the feeding coil antenna 15 illustrated in FIG. 3, but a little wider gap G is provided. Also in this feeding coil antenna 15, an end portion of the first coil portion 15A is arranged near the inner side portions of the coil conductors 22 and 23 and an end portion of the second coil portion 15B is arranged near the outer side portions of the coil conductors 22 and 23, in plan view. As a result, as illustrated in FIG. 9B, a magnetic flux $\phi 1$ radiated from the end portion of the second coil portion 15B flows to the end portion of the first coil portion 15A passing through a portion directly above the coil conductors 22 and 23, thus defining a closed loop. Further, a leakage magnetic flux $\phi 2$ radiated from the end portion of the second coil portion 15B flows through a portion directly above the coil conductors 22 and 23 and returns to the second coil portion 15B, thus defining a closed loop. As a result, the degree of coupling between the feeding coil antenna 15 and the booster coil antenna 20 is increased and the communication characteristics are enhanced.

Figure 10:
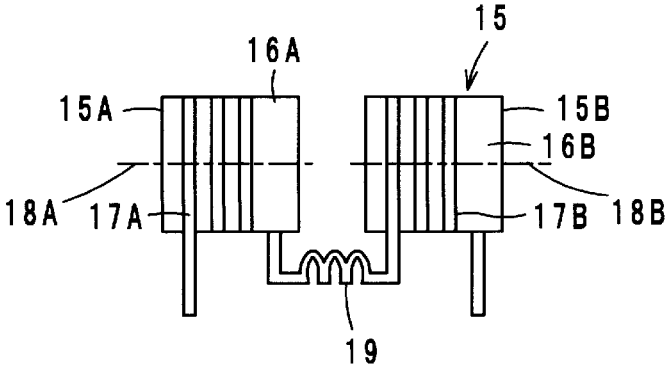
FIG. 10 is an explanation diagram illustrating a fifth example of the feeding coil antenna.

A fifth example of the feeding coil antenna 15 will be described with reference to FIG. 10. This feeding coil antenna has a configuration in which an inductor 19 is arranged between coil conductors 17A and 17B of first and second coil portions 15A and 15B. As a result, the inductance of the feeding coil antenna 15 is increased. The inductor 19 may be, for example, a chip inductor or may be a meandering or coil-shaped conductor pattern provided on the substrate.

Figure 11:
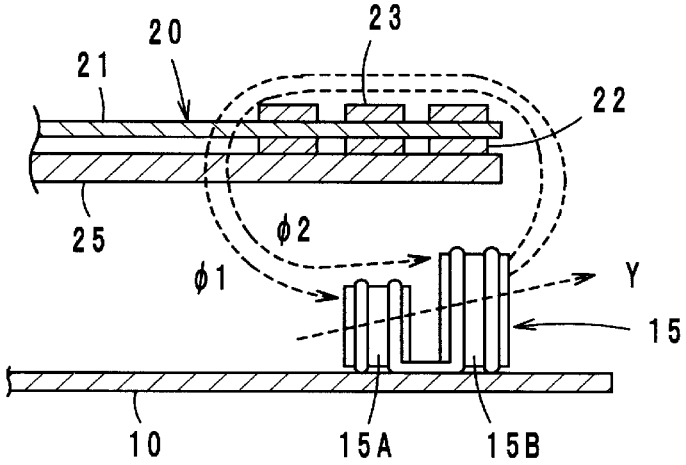
FIG. 11 is an explanation diagram illustrating a sixth example of the feeding coil antenna and electromagnetic coupling between the feeding coil antenna and the booster coil antenna.

A sixth example of the feeding coil antenna 15 will be described with reference to FIG. 11. This feeding coil antenna 15 has a configuration in which a first coil portion 15A has a relatively small diameter and a second coil portion 15B has a relatively large diameter. As a result, a magnetic flux $\phi 1$ radiated from an end portion of the second coil portion 15B flows to an end portion of the first coil portion 15A passing through a portion directly above the coil conductors 22 and 23, thereby defining a closed loop. Further, a leakage magnetic flux $\phi 2$ radiated from the end portion of the second coil portion 15B flows through a portion directly above the coil conductors 22 and 23 and returns to the second coil portion 15B, thus defining a closed loop. As a result, the degree of coupling between the feeding coil antenna 15 and the booster coil antenna 20 is increased and the communication characteristics are enhanced. Further, a flux flowing through the coil portions 15A and 15B can be given a high directivity in a direction inclined with respect to the printed wire substrate 10 (refer to an arrow Y).

Figure 12:
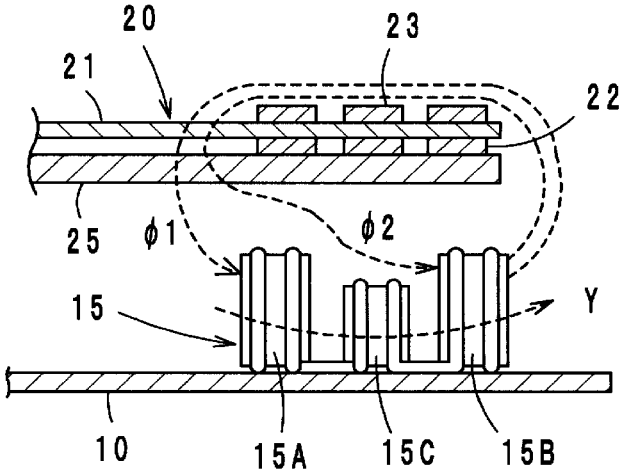
FIG. 12 is an explanation diagram illustrating a seventh example of the feeding coil antenna and electromagnetic coupling between the feeding coil antenna and the booster coil antenna.

A seventh example of the feeding coil antenna 15 will be described with reference to FIG. 12. This feeding coil antenna 15 has a configuration in which a third coil portion 15C having a relatively small diameter is provided between first and second coil portions 15A and 15B. A magnetic flux $\phi$1 radiated from an end portion of the second coil portion 15B flows to the end portion of the first coil portion 15A passing through a portion directly above the coil conductors 22 and 23, thus defining a closed loop. Further, a leakage magnetic flux $\phi$2 radiated from the end portion of the second coil portion 15B flows through a portion directly above the coil conductors 22 and 23 and returns to the second coil portion 15B, thus defining a closed loop. As a result, the degree of coupling between the feeding coil antenna 15 and the booster coil antenna 20 is increased and the communication characteristics are enhanced. The magnetic flux passing through the coil portions 15A, 15B, and 15C is given a high directivity along a curved path (refer to an arrow Y).

In the present antenna device, the magnetic layer 25 is arranged between the feeding coil antenna 15 and the booster coil antenna 20. Here, the operation of the magnetic layer 25 will be described with reference to FIG. 13. The magnetic layer 25 is preferably made of ferrite.

Figure 13A:
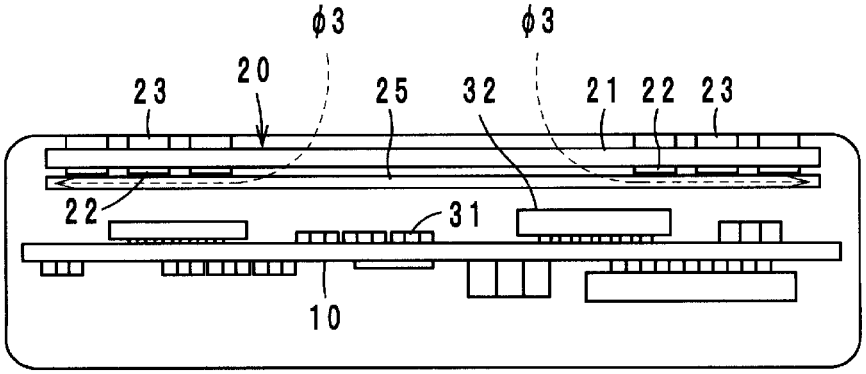
FIG. 13A is an explanation diagram illustrating the operation of a magnetic layer and FIG. 13B is an explanation diagram illustrating a comparative example.
Figure 13B:
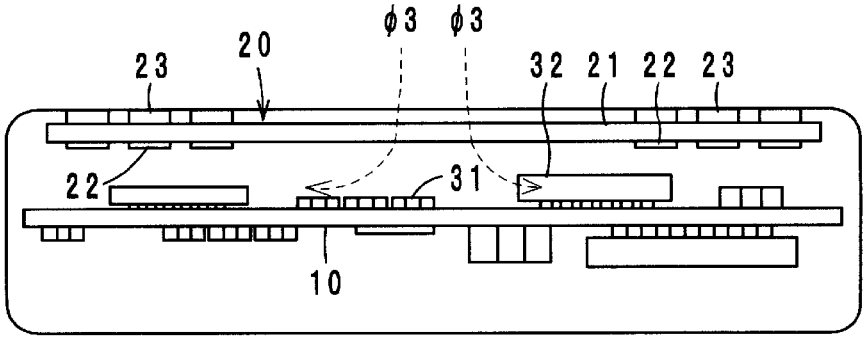

FIG. 13 illustrates a schematic internal configuration of a wireless communication apparatus (specifically, a cellular phone), and various electronic components 31 and an IC 32 other than the feeding coil antenna 15 are mounted on the printed wire substrate 10. If the magnetic layer 25 is not arranged, a magnetic flux $\phi$3 passing through the booster coil antenna 20 collides with the electronic components 31 and the IC 32, as illustrated in FIG. 13B. On the other hand, the magnetic flux $\phi$3 is drawn into the magnetic layer 25 as illustrated in FIG. 13A by arranging the magnetic layer 25. As a result, interference with the electronic components 31 and the IC 32 is considerably avoided and the communication characteristics are enhanced.

Other Preferred Embodiments

Note that the antenna device and the wireless communication apparatus according to the present invention are not limited to the preferred embodiments described above, and various modifications are possible within the scope of the present invention.

In particular, for example, details of the configurations and shapes of the feeding coil antenna and booster coil antenna are not particularly limited. Further, the present invention is not limited to a wireless communication apparatus for NFC in an HF band, and may be used in other frequency bands, such as a UHF band, and other communication systems.

As described above, preferred embodiments of the present invention are useful for antenna devices and communication apparatuses and, in particular, provide an advantage in that the degree of coupling between a feeding coil antenna and a booster coil antenna is easily adjusted and the degree of coupling is increased.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

a feeding coil antenna; and a booster coil antenna electromagnetically coupled to the feeding coil antenna; wherein the feeding coil antenna includes a plurality of coil portions including at least one magnetic body and each including a coil conductor wound around the at least one magnetic body;

the plurality of coil portions are connected to one another in an in-phase mode, and are arranged such that winding axes of the coil conductors are oriented approximately in a same direction and at least portions of respective openings of the coil conductors of at least two adjacent coil portions of the plurality of coil portions face one another with a gap therebetween; and the at least two adjacent coil portions are configured and arranged such that a first magnetic flux radiated from the feeding coil antenna defines a closed loop going around the coil conductors of the at least two adjacent coil portions so that the feeding coil antenna and the booster coil antenna are electromagnetically coupled to each other, and a second magnetic flux passing parallel to and on an inner side of the first magnetic flux penetrates into the gap between the at least two adjacent coil portions to define a closed loop.

2. The antenna device according to claim 1, wherein the respective coil conductors of the plurality of coil portions are connected in series or in parallel with one another.

3. The antenna device according to claim 1, wherein the at least one magnetic body included in the plurality of coil portions includes first and second magnetic bodies arranged independently for first and second coil portions of the plurality of coil portions.

4. The antenna device according to claim 3, wherein the plurality of coil portions are arranged such that the winding axes of the coil conductors coincide with each other.

5. The antenna device according to claim 3, wherein the winding axes of the plurality of coil conductors do not coincide with each other.

6. The antenna device according to claim 3, wherein the respective magnetic bodies included in the plurality of coil portions have different external sizes at portions on which the respective coil conductors are wound.

7. The antenna device according to claim 1, wherein the at least one magnetic body included in the plurality of coil potions includes a single body common to the first and second coil portions and includes a cut-out portion which partly isolates the respective openings of the first and second coil portions from each other.

8. The antenna device according to claim 1, wherein the respective coil conductors of the first and second coil portions have different numbers of turns.

9. The antenna device according to claim 1, wherein a magnetic layer is arranged between the feeding coil antenna and the booster coil antenna.

10. The antenna device according to claim 1, wherein the plurality of coil portions are arranged near a portion of a side of the booster antenna when viewed in plan in the winding axis direction of the booster coil antenna.

11. A wireless communication apparatus comprising:

a feeding circuit;

a feeding coil antenna connected to the feeding circuit; and a booster coil antenna electromagnetically coupled to the feeding coil antenna; wherein the feeding coil antenna includes a plurality of coil portions including at least one magnetic body and each including a coil conductor wound around the at least one magnetic body; and the plurality of coil portions are connected to one another in an in-phase mode, and are arranged such that winding axes of the coil conductors are oriented approximately in a same direction and at least portions of respective openings of the coil conductors of at least two adjacent coil portions of the plurality of coil portions face one another with a gap therebetween; and the at least two adjacent coil portions are configured and arranged such that a first magnetic flux radiated from the feeding coil antenna defines a closed loop going around the coil conductors of the at least two adjacent coil portions so that the feeding coil antenna and the booster coil antenna are electromagnetically coupled to each other, and a second magnetic flux passing parallel to and on an inner side of the first magnetic flux penetrates into the gap between the at least two adjacent coil portions to define a closed loop.

12. The wireless communication apparatus according to claim 11, wherein the respective coil conductors of the plurality of coil portions are connected in series or in parallel with one another.

13. The wireless communication apparatus according to claim 11, wherein the at least one magnetic body included in the plurality of coil portions includes first and second magnetic bodies arranged independently for first and second coil portions of the plurality of coil portions.

14. The wireless communication apparatus according to claim 13, wherein the plurality of coil portions are arranged such that the winding axes of the coil conductors coincide with each other.

15. The wireless communication apparatus according to claim 13, wherein the winding axes of the plurality of coil conductors do not coincide with each other.

16. The wireless communication apparatus according to claim 13, wherein the respective magnetic bodies included in the plurality of coil portions have different external sizes at portions on which the respective coil conductors are wound.

17. The wireless communication apparatus according to claim 11, wherein the at least one magnetic body included in the plurality of coil potions includes a single body common to the first and second coil portions and includes a cut-out portion which partly isolates the respective openings of the first and second coil portions from each other.

18. The wireless communication apparatus according to claim 11, wherein the respective coil conductors of the first and second coil portions have different numbers of turns.

19. The wireless communication apparatus according to claim 11, wherein a magnetic layer is arranged between the feeding coil antenna and the booster coil antenna.

* * * * *